US010498100B1

(12) United States Patent
Trout et al.

(10) Patent No.: US 10,498,100 B1
(45) Date of Patent: Dec. 3, 2019

(54) ELECTRICAL CONNECTOR ASSEMBLY HAVING PRESS TABS FOR SEATING TOOL

(71) Applicants: TE CONNECTIVITY CORPORATION, Berwyn, PA (US); TYCO ELECTRONICS JAPAN G.K., Kawasaki-shi (JP)

(72) Inventors: David Allison Trout, Lancaster, PA (US); Douglas Edward Shirk, Elizabethtown, PA (US); Masaaki Iwasaki, Yokohama (JP); Yoshihiko Kodaira, Fujisawa (JP); Masayuki Aizawa, Machida (JP)

(73) Assignees: TYCO ELECTRONICS CORPORATION, Berwyn, PA (US); TYCO ELECTRONICS JAPAN G.K., Kawasaki-Shi (JP)

( * ) Notice: Subject to any disclaimer, the term of this patent is extended or adjusted under 35 U.S.C. 154(b) by 0 days.

(21) Appl. No.: 16/028,528

(22) Filed: Jul. 6, 2018

(51) Int. Cl.

| | |
|---|---|
| ***H01R 12/00*** | (2006.01) |
| ***H01R 43/20*** | (2006.01) |
| ***H01R 13/514*** | (2006.01) |
| ***H01R 13/6471*** | (2011.01) |
| ***H01R 12/58*** | (2011.01) |
| ***H01R 12/72*** | (2011.01) |
| ***H01R 13/6587*** | (2011.01) |

(52) U.S. Cl.
CPC ..... *H01R 43/205* (2013.01); *H01R 12/585* (2013.01); *H01R 12/724* (2013.01); *H01R 13/514* (2013.01); *H01R 13/6471* (2013.01); *H01R 13/6587* (2013.01)

(58) Field of Classification Search
CPC .. H01R 43/205; H01R 12/724; H01R 12/585; H01R 13/514; H01R 13/6471; H01R 13/6587
USPC ..... 439/78, 79, 607.07, 943
See application file for complete search history.

(56) References Cited

U.S. PATENT DOCUMENTS

| | | | | |
|---|---|---|---|---|
| 4,050,769 | A * | 9/1977 | Ammon | H01R 23/70 439/701 |
| 4,550,962 | A * | 11/1985 | Czeschka | H01R 12/585 29/739 |
| 5,896,649 | A | 4/1999 | Millhimes et al. | |
| 8,578,596 | B2 | 11/2013 | Barnhouse et al. | |
| 8,834,204 | B2 | 9/2014 | De Bruijn et al. | |
| 8,944,841 | B2 * | 2/2015 | YuQiang | H01R 13/64 439/378 |

* cited by examiner

*Primary Examiner* — Khiem M Nguyen

(57) ABSTRACT

An electrical connector assembly includes a housing having a cavity receiving a stack of contact modules each having a dielectric holder having first and second sides extending between a front and a rear and extending between a top and a bottom. Each contact module includes signal contacts having mating portions and mounting portions extending from the bottom for termination to a circuit board. The dielectric holder includes a press tab extending from the first side proximate to the bottom having press surface pressed downward by a seating tool to press the electrical connector assembly on the circuit board proximate to the bottom of the dielectric holder to seat the mounting portions in vias in the circuit board.

20 Claims, 10 Drawing Sheets

ELECTRICAL CONNECTOR ASSEMBLY HAVING PRESS TABS FOR SEATING TOOL

BACKGROUND OF THE INVENTION

The subject matter herein relates generally to electrical connector assemblies.

Some electrical systems utilize electrical connectors, such as header assemblies and receptacle assemblies, to interconnect two circuit boards, such as a motherboard and daughtercard. Some known electrical connectors include a front housing holding a plurality of contact modules arranged in a contact module stack. The electrical connectors provide electrical shielding for the signal conductors of the contact modules. For example, ground shields may be provided on one or both sides of each contact module. However, at high speeds, the electrical shielding of known electrical connectors may be insufficient. For example, while the ground shield(s) may provide shielding along the sides of the signal conductors, known electrical connectors do not provide sufficient additional electrical shielding above and/or below the signal conductors throughout the length of the contact modules.

Some known electrical connector assemblies have been designed that provide significant electrical shielding in the form of right and left shield members coupled to right and left sides of the dielectric holders of the contact modules along the lengths of the signal contacts. However, much of the dielectric material of the dielectric holders surrounding the signal contacts in such electrical connector assemblies is removed to provide space to locate the shield members, reducing the mechanical stability of the contact modules. Assembly of the contact modules to the circuit board may damage the contact modules, such as by buckling the contact modules under the pressing forces applied to seat the electrical connector assembly on the circuit board. For example, conventional electrical connector assemblies are seated using a seating tool that presses downward against the tops of the contact modules to press-fit the compliant pins of the signals and the ground shields into vias in the circuit board.

A need remains for a robust electrical connector assembly that can withstand seating forces when seating the electrical connector assembly on the circuit board.

BRIEF DESCRIPTION OF THE INVENTION

In one embodiment, an electrical connector assembly is provided including a housing having a mating end and having a cavity at a rear of the housing. The electrical connector assembly includes contact modules arranged in a contact module stack received in the cavity at the rear of the housing. Each contact module includes a dielectric holder having first and second sides extending between a front and a rear and extending between a top and a bottom. Each contact module includes signal contacts having mating portions extending forward of the front into the housing and mounting portions extending from the bottom for termination to vias in a circuit board. The dielectric holder includes at least one press tab extending from at least one of the first side and the second side proximate to the bottom. The at least one press tab includes a corresponding press surface configured to be pressed downward by a seating tool to press the electrical connector assembly on the circuit board proximate to the bottom of the dielectric holder to seat the mounting portions in the vias in the circuit board.

In another embodiment, an electrical connector assembly is provided including a housing having a mating end and having a cavity at a rear of the housing. The electrical connector assembly includes contact modules arranged in a contact module stack received in the cavity at the rear of the housing. Each contact module includes a dielectric holder having first and second sides extending between a front and a rear and extending between a top and a bottom. Each contact module includes signal contacts having mating portions extending forward of the front into the housing and mounting portions extending from the bottom for termination to vias in a circuit board. Each contact module includes a first ground shield provided at the first side of the dielectric holder having mating portions extending forward of the front into the housing and mounting portions extending from the bottom for termination to vias in the circuit board. The dielectric holder includes a first press tab extending from the first side beyond the first ground shield proximate to the bottom. The top of the dielectric holder includes an upper press surface and the first press tab includes a first press surface located closer to the circuit board than the upper press surface. The upper press surface and the first press surface is configured to be pressed downward by a seating tool to press the electrical connector assembly on the circuit board to seat the mounting portions in the corresponding vias in the circuit board.

In a further embodiment, an electrical connector assembly is provided including a housing having a mating end and having a cavity at a rear of the housing. The electrical connector assembly includes contact modules arranged in a contact module stack received in the cavity at the rear of the housing. Each contact module includes a dielectric holder having first and second sides extending between a front and a rear and extending between a top and a bottom. Each contact module includes signal contacts having mating portions extending forward of the front into the housing and mounting portions extending from the bottom for termination to vias in a circuit board. Each contact module includes a first ground shield provided at the first side of the dielectric holder and a second ground shield provided at the second side of the dielectric holder. The first ground shield has mating portions extending forward of the front into the housing and mounting portions extending from the bottom for termination to vias in the circuit board. The second ground shield has mating portions extending forward of the front into the housing and mounting portions extending from the bottom for termination to vias in the circuit board. The dielectric holder includes a first press tab extending from the first side beyond the first ground shield proximate to the bottom and a second press tab extending from the second side beyond the second ground shield proximate to the bottom. The first press tab includes a first press surface and the second press tab includes a second press surface, the first and second press surfaces configured to be pressed downward by a seating tool to press the electrical connector assembly on the circuit board proximate to the bottom of the dielectric holder to seat the mounting portions in the corresponding vias in the circuit board.

DETAILED DESCRIPTION OF THE INVENTION

Figure 1:
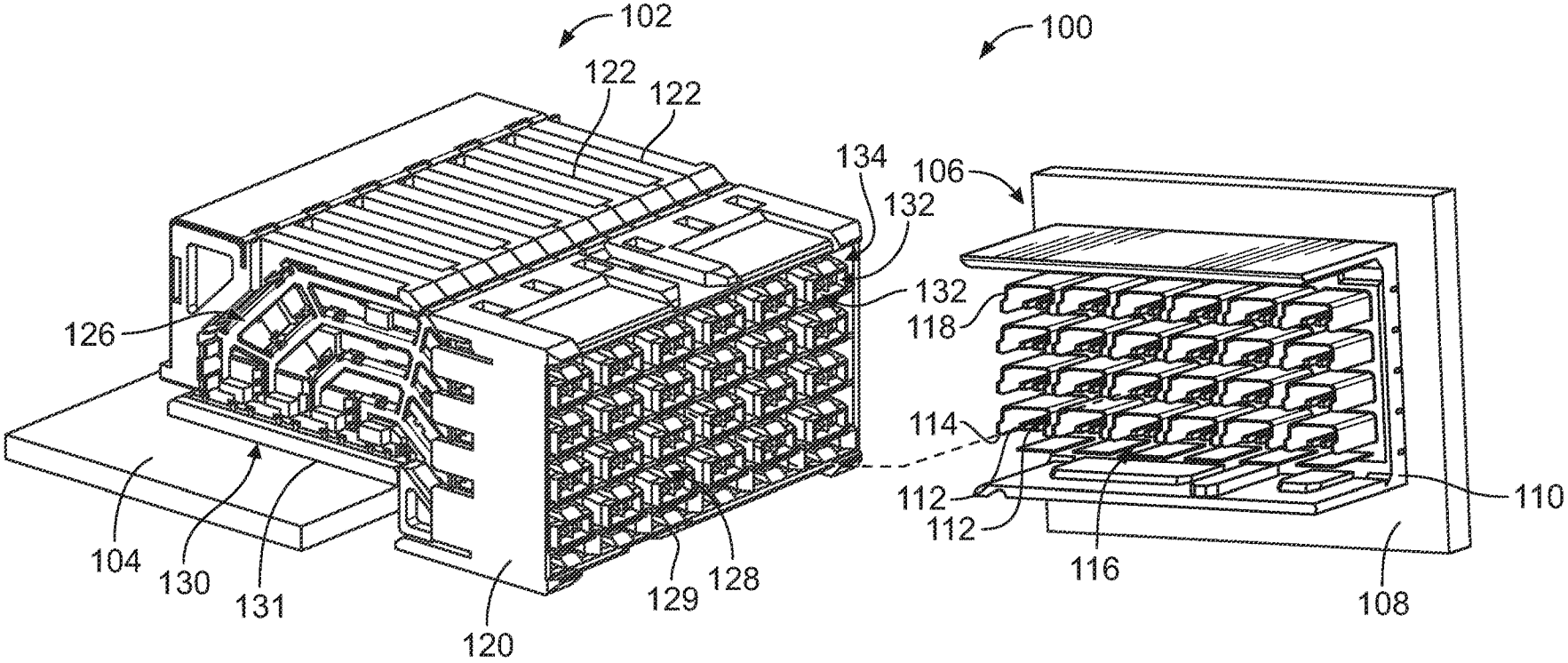
FIG. 1 is a front perspective view of an electrical connector system formed in accordance with an exemplary embodiment.

FIG. 1 is a front perspective view of an electrical connector system 100 formed in accordance with an exemplary embodiment. The connector system 100 includes an electrical connector assembly 102 configured to be mounted to a circuit board 104 and a mating electrical connector 106, which may be mounted to a circuit board 108. The mating electrical connector 106 may be a header connector. Various types of connector assemblies may be used in various embodiments, such as a right angle connector, a vertical connector or another type of connector.

The mating electrical connector 106 includes a housing 110 holding a plurality of mating signal contacts 112 and mating ground shields 114. The mating signal contacts 112 may be arranged in pairs 116. Each mating ground shield 114 extends around corresponding mating signal contacts 112, such as the pairs 116 of mating signal contacts 112. In the illustrated embodiment, the mating ground shields 114 are C-shaped having three walls extending along three sides of each pair of mating signal contacts 112. The mating ground shield 114 adjacent to the pair 116 provides electrical shielding along a fourth side of the pair 116. As such, the pairs 116 of mating signal contacts 112 are circumferentially surrounded on all four sides by the mating ground shields 114. The mating ground shields 114 extend to edges 118. Other types of mating electrical connectors may be provided in alternative embodiments. For example, the mating electrical connector 106 may include contact modules, such as pair-in-row contact modules or pair-in column contact modules. The contact modules may be coupled to a circuit board oriented parallel to the circuit board 104 or perpendicular to the circuit board 104.

The electrical connector assembly 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector assembly 102. The contact modules 122 each include a plurality of signal contacts 124 (shown in FIG. 2) that define signal paths through the electrical connector assembly 102. The signal contacts 124 are configured to be electrically connected to corresponding mating signal contacts 112 of the mating electrical connector 106.

The electrical connector assembly 102 includes a mating end 128, such as at a front 129 of the electrical connector assembly 102, and a mounting end 130, such as at a bottom 131 of the electrical connector assembly 102. In the illustrated embodiment, the mounting end 130 is oriented substantially perpendicular to the mating end 128. The mating and mounting ends 128, 130 may be at different locations other than the front 129 and bottom 131 in alternative embodiments. The signal contacts 124 extend through the electrical connector assembly 102 from the mating end 128 to the mounting end 130 for mounting to the circuit board 104.

The signal contacts 124 are received in the housing 120 and held therein at the mating end 128 for electrical termination to the mating electrical connector 106. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single-ended applications. Optionally, the pairs of signal contacts 124 may be arranged in rows (pair-in-row signal contacts); however, the pairs of signal contacts may be arranged in columns (pair-in-column signal contacts) in alternative embodiments. The signal contacts 124 within each pair may be contained within the same contact module 122.

In an exemplary embodiment, each contact module 122 has a shield structure 126 for providing electrical shielding for the signal contacts 124. The shield structure is configured to be electrically connected to the mating ground shields 114 of the mating electrical connector 106. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 provide shielding for each pair of signal contacts 124 along substantially the entire length of the signal contacts 124 between the mating end 128 and the mounting end 130. In an exemplary embodiment, the shield structure 126 is configured to be electrically connected to the mating electrical connector and/or the circuit board 104. The shield structure 126 may be electrically connected to the circuit board 104 by features, such as grounding pins and/or surface tabs.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding mating signal contacts 112 of the mating electrical connector 106. In the illustrated embodiment, the ground contact openings 134 are C-shaped extending along three sides of the corresponding pair of signal contact openings 132. The ground contact openings 134 receive mating ground shields 114 of the mating electrical connector 106. The ground contact openings 134 also receive portions of the shield structure 126 (for example, beams and/or fingers) of the contact modules 122 that mate with the mating ground shields 114 to electrically common the shield structure 126 with the mating electrical connector 106.

The housing 120 is manufactured from a dielectric material, such as a plastic material, and provides isolation between the signal contact openings 132 and the ground contact openings 134. The housing 120 isolates the signal contacts 124 from the shield structure 126. The housing 120 isolates each set (for example, differential pair) of signal contacts 124 from other sets of signal contacts 124.

During assembly, the electrical connector assembly 102 is mounted to the circuit board 104 by pressing downward on the electrical connector assembly 102. For example, a seating tool may be used to seat the electrical connector assembly 102 on the circuit board 104. The seating tool presses downward on the electrical connector assembly 102. In an exemplary embodiment, the seating tool is configured to press against the top of the contact modules 122 and is configured to press against the bottom of the contact modules 122 to seat the contact modules 122 on the circuit board 104. By engaging the bottom of the contact modules 122, the pressing force may be located close to the circuit board to avoid damage to the contact modules 122.

Figure 2:
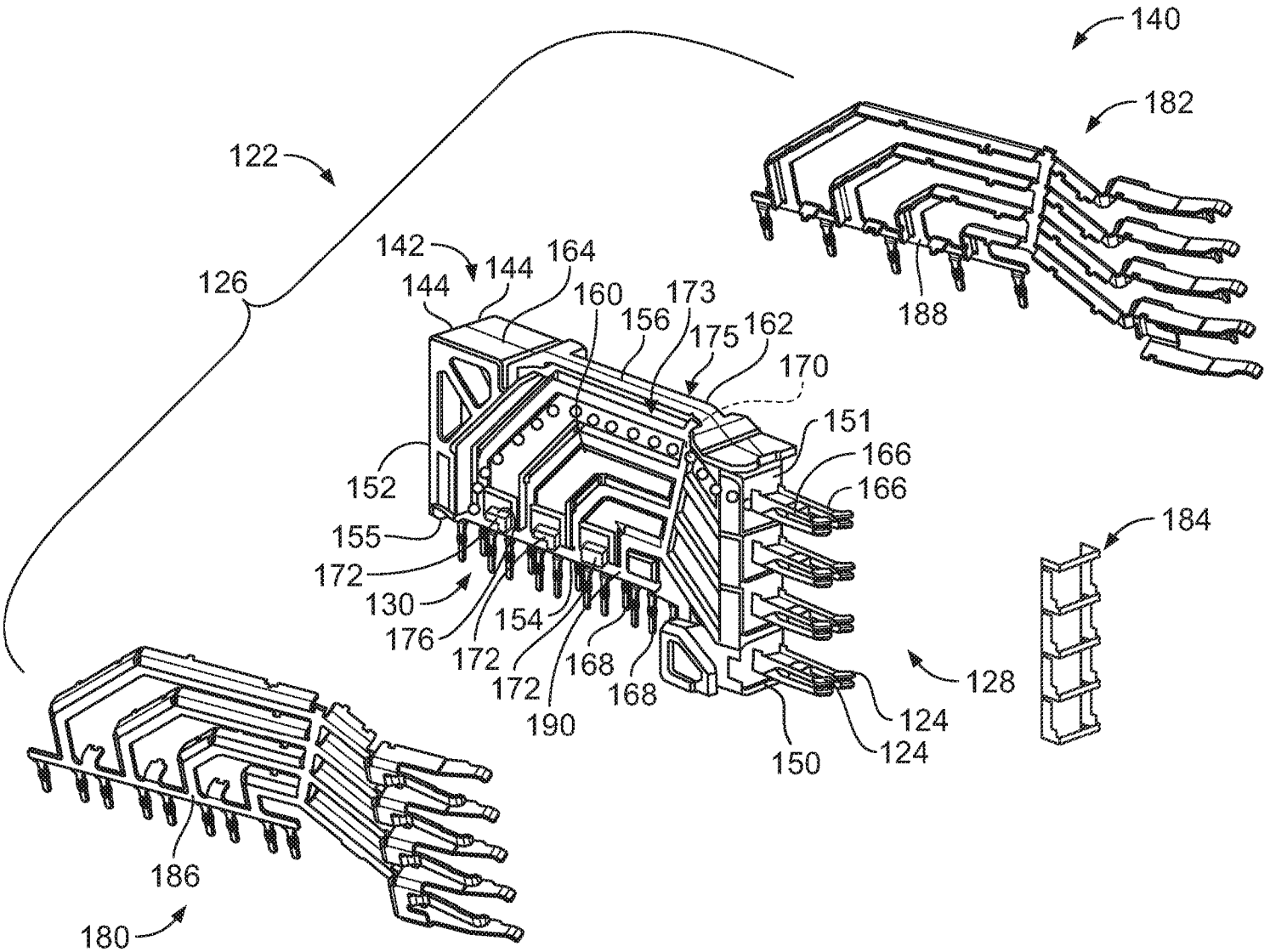
FIG. 2 is an exploded view of a contact module of an electrical connector assembly in accordance with an exemplary embodiment.
Figure 3:
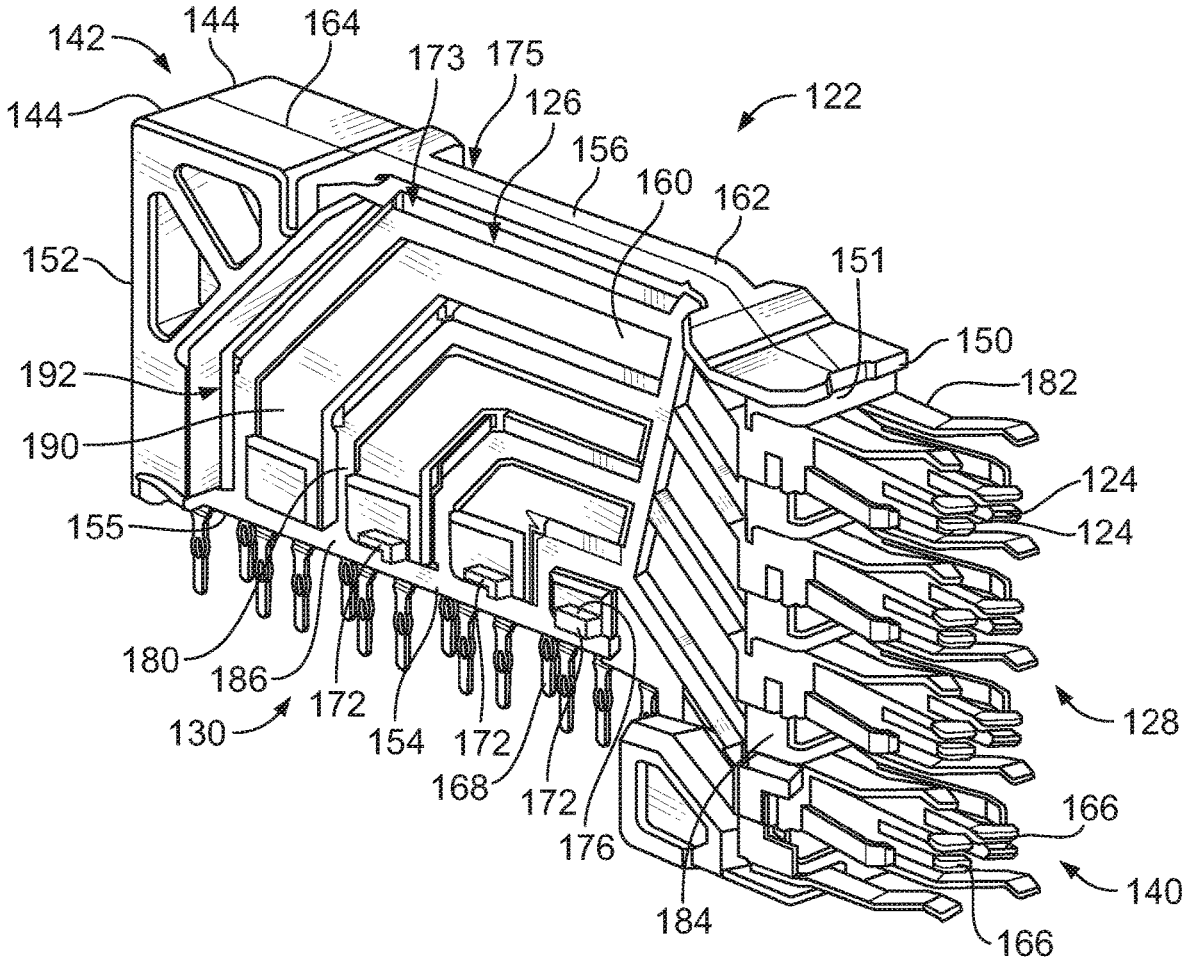
FIG. 3 is an assembled view of the contact module.
Figure 4:
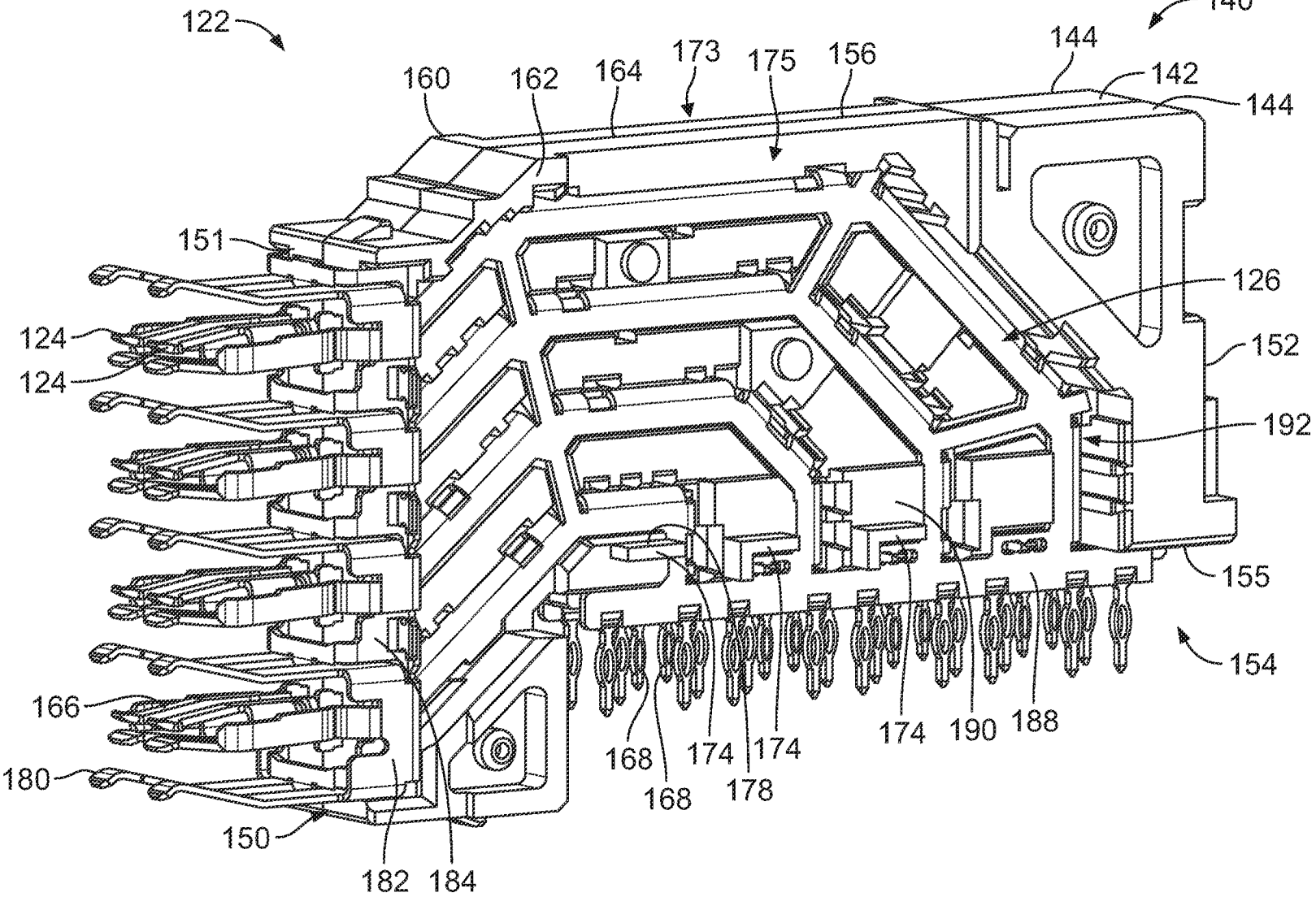
FIG. 4 is an assembled view of the contact module.

FIG. 2 is an exploded view of one of the contact modules 122 in accordance with an exemplary embodiment. FIG. 3 is an assembled view of a right side of the contact module 122. FIG. 4 is an assembled view of a left side of the contact module 122. The contact module 122 includes a frame assembly 140 having an array of the signal contacts 124 and a dielectric holder 142 holding the signal contacts 124. The dielectric holder 142 generally surrounds the signal contacts 124 along substantially the entire length of the signal contacts 124 between the mounting end 130 at the bottom and the mating end 128 at the front. The shield structure 126 is coupled to the dielectric holder 142 to provide electrical shielding for the signal contacts 124, such as for each pair of the signal contacts 124. The shield structure 126 provides circumferential shielding for each pair of signal contacts 124 along at least a majority of a length of the signal contacts 124, such as substantially an entire length of the signal contacts 124.

In an exemplary embodiment, the frame assembly 140 is assembled together from two contact sub-assemblies. For example, the dielectric holder 142 may be a two-piece holder formed from two dielectric bodies 144 arranged side-by-side. Each dielectric body 144 surrounds a corresponding array of signal contacts 124. The dielectric body 144 may be overmolded over the signal contacts 124 (for example, each dielectric body 144 may be overmolded over a set of the signal contacts 124 to form one of the contact sub-assemblies). Optionally, the signal contacts 124 may be initially formed from a leadframe and overmolded by the corresponding dielectric body 144 such that portions of the signal contacts 124 are encased in the dielectric holder 142.

The dielectric holder 142 has a mating end 150 at a front 151 thereof configured to be loaded into the housing 120 (shown in FIG. 1), a rear 152 opposite the mating end 150, a mounting end 154 at a bottom 155 which optionally may be adjacent to the circuit board 104 (shown in FIG. 1), and a top 156 generally opposite the mounting end 154. The dielectric holder 142 also includes first and second sides, such as a right side 160 and a left side 162. The shield structure 126 is coupled to both the right and left sides 160, 162. The dielectric bodies 144 include respective interior sides 164 facing and abutting each other. Each dielectric body 144 holds one of the signal contacts 124 from each pair such that the pair has signal contacts 124 in both contact sub-assemblies. When assembled, the signal contacts 124 in each pair are aligned with each other and follow similar paths between the mating and mounting ends 128, 130. For example, the signal contacts 124 have similar shapes and thus have similar lengths, which reduces or eliminates skew in the signal paths for the pairs. The pair-in-row arrangement may enhance the electrical performance of the contact module 122 as compared to pair-in-column contact modules having the signal contacts of each pair radially offset from each other (for example, one radially inside and the other radially outside), leading to skew problems.

The signal contacts 124 may be stamped and formed from a sheet of metal material. Each signal contact 124 has a mating portion 166 extending forward from the mating end 150 of the dielectric holder 142 and a mounting portion 168 extending downward from the mounting end 154. The mating and mounting portions 166, 168 are exposed beyond the front 151 and the bottom 155, respectively, of the dielectric holder 142. Each signal contact 124 has a transition portion 170 (one of which is shown in phantom in FIG. 2) between the mating and mounting portions 166, 168. The transition portions 170 each include a top, a bottom, a right side, and a left side. In an exemplary embodiment, the top, bottom, and corresponding outer side are each configured to be shielded by the shield structure 126. The mating portions 166 are configured to be electrically terminated to corresponding mating signal contacts 112 (shown in FIG. 1) when the electrical connector assembly 102 is mated to the mating electrical connector 106 (shown in FIG. 1). In an exemplary embodiment, the mounting portions 168 include compliant pins, such as eye-of-the-needle pins, configured to be terminated to the circuit board 104 (shown in FIG. 1).

In an exemplary embodiment, the dielectric holder 142 includes press tabs extending from the first side 160 and/or the second side 162. For example, in the illustrated embodiment, the dielectric holder 142 includes first press tabs 172 extending from the first side 160 and second press tabs 174 extending from the second side 162. Any number of press tabs 172 may be provided at the first side 160 and any number of press tabs 174 may be provided at the second side 162. The first press tabs 172 extend beyond the first side 160 and thus stand proud (i.e., extend from) of the first side 160 to interface with the seating tool when the seating tool is coupled to the electrical connector assembly 102. The second press tabs 174 extend beyond the second side 162 and thus stand proud of the second side 162 to interface with the seating tool when the seating tool is coupled to the electrical connector assembly 102. The press tabs 172 may be separated from each other by gaps to allow a ground shield to be mounted to the dielectric holder 142. Similarly, the press tabs 174 may be separated from each other by gaps to allow a ground shield to be mounted to the dielectric holder 142. In an exemplary embodiment, the press tabs 172, 174 are integral with the dielectric bodies 144. For example, the press tabs 172, 174 are co-molded with the dielectric bodies 144. In an exemplary embodiment, the press tabs 172, 174 are located proximate to the bottom 155 of the dielectric holder 142. For example, the press tabs 172, 174 are located proximate to the mounting portions 168 of the signal contacts 124.

The press tabs 172, 174 extend outward from the sides 160, 162 and may be unobstructed above the press tabs 172, 174 such that the press tabs 172, as 174 may be engaged from above by a seating tool. For example, a first pocket 173 may be located above the first press tabs 172 and a second pocket 175 may be located above the second press tabs 174. The pockets 173, 175 are open at the top 156 of the dielectric holder 142 to receive the seating tool. The first press tabs 172 have first press surfaces 176 and the second press tabs 174 have second press surfaces 178. The press surfaces 176, 178 are upward facing. For example, the press surfaces 176, 178 face the pockets 173, 175, respectively. The press surfaces 176, 178 are configured to be engaged by a seating tool and are configured to be pressed downward during the seating operation.

In an exemplary embodiment, the shield structure 126 includes first and second ground shields 180, 182 and a ground clip 184. The ground clip 184 is configured to be assembled to the dielectric holder 142, such as immediately forward of the mating end 150 of the dielectric holder 142. In an exemplary embodiment, the ground clip 184 spans or covers the mating end 150 of the dielectric holder 142 between the right and the left sides 160, 162. The ground clip 184 is configured to be positioned between the mating ground shields 114 (FIG. 1) and the dielectric holder 142 and is thus positioned adjacent the mating zone between the signal contacts 124 and the mating signal contacts 112 (FIG. 1). The ground clip 184 is configured to be electrically connected to the first and second ground shields 180, 182 such that the ground shields 180, 182 are electrically commoned adjacent the mating zone. Optionally, the ground clip 184 may be used to mechanically secure the first ground shield 180 and/or the second ground shield 182 to the contact module 122. The ground clip 184 provides electrical shielding for the signal contacts 124 at the exit/entrance points of the signal contacts 124 from the dielectric holder 142. The ground clip 184 provides electrical shielding for the mating portions 166 of the signal contacts 124 adjacent the mating zone. The ground clip 184 may extend forward along the mating portions 166, such as along the sides and/or along the tops in various embodiments. For example, the ground clip 184 may have C-shaped members that provide shielding along the mating portions 166.

The first and second ground shields 180, 182 cooperate to provide circumferential shielding for each pair of signal contacts 124 along the length thereof. The first ground shield 180 is positioned along the right side 160 of the dielectric holder 142, and as such, may be hereinafter referred to as the right ground shield 180. The second ground shield 182 is positioned along the left side 162 of the dielectric holder 142, and may be hereinafter referred to as the left ground shield 182. The first and second ground shields 180, 182 electrically connect the contact module 122 to the mating electrical connector 106, such as to the mating ground shields 114 thereof (shown in FIG. 1), thereby providing an electrically common ground path between the electrical connector assembly 102 and the mating electrical connector 106. The first and second ground shields 180, 182 electrically connect the contact module 122 to the circuit board 104, such as through compliant pins thereof. The first and second ground shields 180, 182 may be similar and include similar features and components. As such, the description below may include description of either ground shield, which may be relevant to the other ground shield, and like components may be identified with like reference numerals.

In an exemplary embodiment, the first ground shield 180 includes a press bar 186 and a bottom thereof and the second ground shield 182 includes a press bar 188 and a bottom thereof. The press bars 186, 188 extend along the length of the ground shields 180, 182. In the illustrated embodiment, the press bars 186, 188 extend along the bottom 155 of the dielectric holder 142. In an exemplary embodiment, the dielectric holder 142 may press downward on the press bars 186, 188 during the seating operation to press the mounting portions of the ground shields 180, 182 into the vias of the circuit board 104.

In an exemplary embodiment, the dielectric holder 142 includes web portions 190 between signal contacts 124. The web portions 190 hold the relative positions of the signal contacts 124. The web portions 190 have channels 192 that receive the ground shields 180, 182 to allow the ground shields 180, 182 to pass through the dielectric holder 142. The press tabs 172, 174 extend from corresponding web portions 190 at the bottom 155 of the dielectric holder 142. When the press tabs 172, 174 are pressed downward by the seating tool during the seating operation, the press tabs 172, 174 force the corresponding web portions 190 downward. The web portions 190 correspondingly force the adjacent signal contacts 124 downward to drive the mounting portions 168 of the signal contacts 124 downward into the vias of the circuit board 104. In an exemplary embodiment, the web portions 190 extend above and engage the press bars 186, 188. The web portions 190 drive the press bars 186, 188 downward to drive the ground shields 180, 182 into the circuit board 104 during the seating operation. As such, downward pressure on the press tabs 172, 174 is transferred to the signal contacts 124 and the ground shields 180, 182 by the web portions 190.

Figure 5:
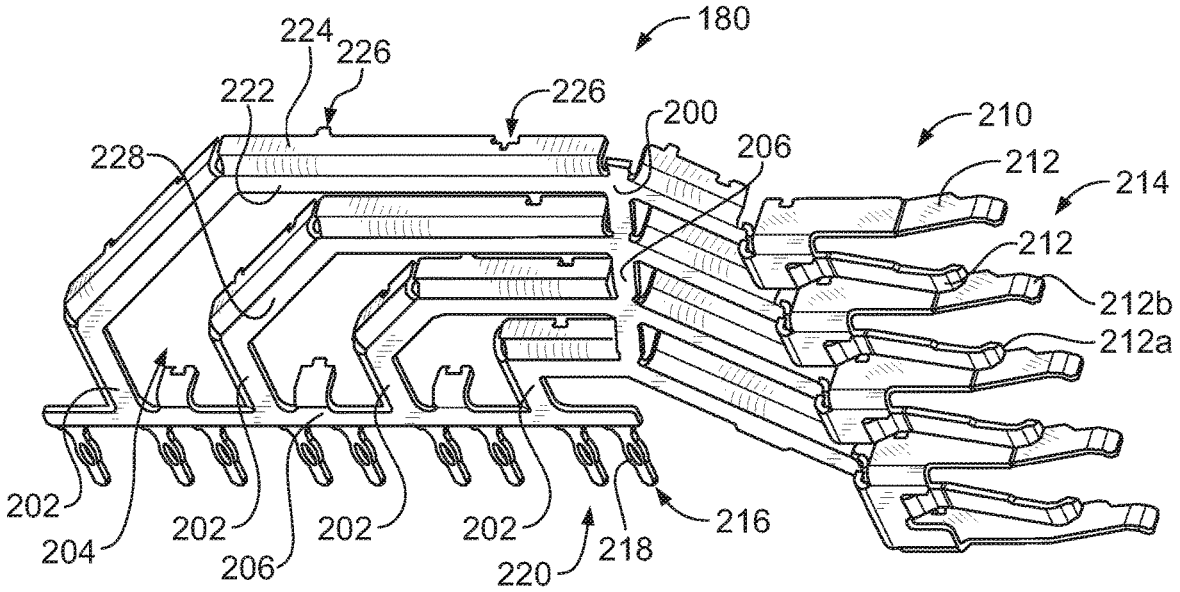
FIG. 5 is a perspective view of a ground shield of the contact module in accordance with an exemplary embodiment.

FIG. 5 is a perspective view of the first ground shield 180 in accordance with an exemplary embodiment. In an exemplary embodiment, the first ground shield 180 is stamped and formed from a stock piece of metal material. The first ground shield 180 includes a main body 200 configured to extend along the right side 160 of the dielectric holder 142 (both shown in FIG. 2). The main body 200 includes a plurality of right side rails 202 separated by right side gaps 204, the right side rails 202 being interconnected by struts 206 that span the gaps 204 between the right side rails 202.

The first ground shield 180 includes mating portions 210 defined by mating beams 212 at a mating end 214 of the main body 200. The mating portions 210 are configured to be mated with corresponding mating portions of the mating electrical connector 106 (for example, the C-shaped mating ground shields 114, shown in FIG. 1). In an exemplary embodiment, the first ground shield 180 includes side mating beams 212*a* and top mating beams 212*b* configured to extend along the sides and the tops of the corresponding signal contacts 124. The mating beams 212 may be deflectable mating beams, such as spring beams. Optionally, the mating beams 212 are configured to be received inside the corresponding C-shaped mating ground shields 114 of the mating electrical connector 106. Alternatively, the mating beams 212 are configured to extend along the outside of the corresponding C-shaped mating ground shields 114 of the mating electrical connector.

The first ground shield 180 includes mounting portions 216 defined by compliant pins 218 at a mounting end 220 of the main body 200. The mounting portions 216 are configured to be terminated to the circuit board 104 (shown in FIG. 1). For example, the mounting portions 216 are configured to be received in plated vias in the circuit board 104.

The right side rails 202 are configured to provide shielding around corresponding signal contacts 124 (shown in FIG. 2). For example, in an exemplary embodiment, the right side rails 202 have side strips 222 configured to extend along the right side 160 of the dielectric holder 142, and connecting strips 224 configured to extend into the dielectric holder 142 and extend between adjacent signal contacts 124. The connecting strips 224 are bent perpendicular to and extend from the corresponding side strips 222. The right side rails 202 form right angle shielded spaces that receive corresponding signal contacts 124 to provide electrical shielding along the sides of the signal contacts 124 and between the signal contacts 124, such as above and/or below corresponding signal contacts 124. The struts 206 interconnect the right side rails 202 to hold the relative positions of the right side rails 202. The gaps 204 are defined between the right side rails 202 and generally follow the paths of the right side rails 202.

In an exemplary embodiment, each connecting strip 224 includes a commoning feature 226 for electrically connecting to the second ground shield 182 (shown in FIG. 2). In the illustrated embodiment, the commoning features 226 are commoning tabs that extend outward from the connecting strips 224 and commoning slots; however, other types of commoning features may be used in alternative embodiments, such as channels, spring beams, and the like. The commoning features 226 may be deflectable to engage and securely couple the first ground shield 180 to the second ground shield 182 when mated thereto. For example, the commoning features 226 may be clips.

The right side rails 202 are configured to extend along and follow the paths of the signal contacts 124, such as between the mating end 128 and the mounting end 130 (both shown in FIG. 1) of the electrical connector assembly 102. For example, the right side rails 202 may transition from the mating end 214 to the mounting end 220 and have different segments or portions 228 that are angled relative to each other as the right side rails 202 transition between the mating and mounting ends 214, 220.

Figure 6:
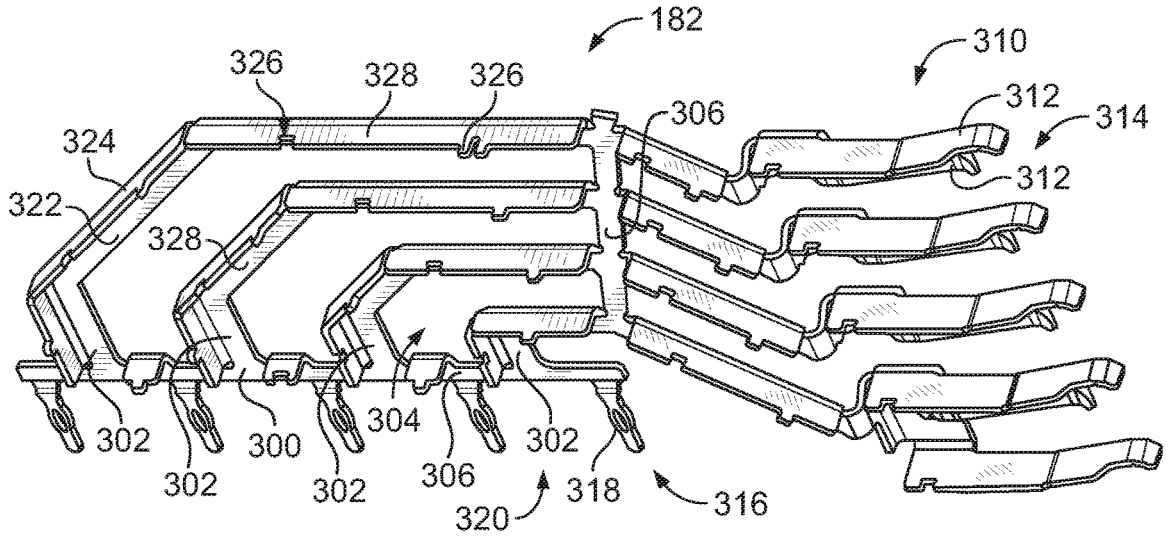
FIG. 6 is a perspective view of a ground shield of the contact module in accordance with an exemplary embodiment.

FIG. 6 is a perspective view of the second ground shield 182 in accordance with an exemplary embodiment. In an exemplary embodiment, the second ground shield 182 is stamped and formed from a stock piece of metal material. The second ground shield 182 includes a main body 300 configured to extend along the left side 162 of the dielectric holder 142 (both shown in FIG. 2). The main body 300 includes a plurality of left side rails 302 separated by gaps 304, the left side rails 302 being interconnected by struts 306 that span the gaps 304 between the rails 302.

The second ground shield 182 includes mating portions 310 defined by mating beams 312 at a mating end 314 of the main body 300. The mating portions 310 are configured to be mated with corresponding mating portions of the mating electrical connector (for example, the C-shaped mating ground shields 114, shown in FIG. 1). In an exemplary embodiment, the second ground shield 182 includes side mating beams 312 and top mating beams 312 configured to extend along the sides and the tops of the corresponding signal contacts 124. The mating beams 312 may be deflectable mating beams, such as spring beams. Optionally, the mating beams 312 are configured to be received inside the corresponding C-shaped mating ground shields 114 of the mating electrical connector 106. Alternatively, the mating beams 312 are configured to extend along the outside of the corresponding C-shaped mating ground shields 114 of the mating electrical connector.

The second ground shield 182 includes mounting portions 316 defined by compliant pins 318 at a mounting end 320 of the main body 300. The mounting portions 316 are configured to be terminated to the circuit board 104 (shown in FIG. 1). For example, the mounting portions 316 are configured to be received in plated vias in the circuit board 104.

The left side rails 302 are configured to provide shielding around corresponding signal contacts 124 (shown in FIG. 2). For example, in an exemplary embodiment, the left side rails 302 have side strips 322 configured to extend along the left side 162 of the dielectric holder 142, and connecting strips 324 configured to extend into the dielectric holder 142 and extend between adjacent signal contacts 124. The connecting strips 324 are bent perpendicular to and extend from the corresponding side strips 322. The left side rails 302 form right angle shielded spaces that receive corresponding signal contacts 124 to provide electrical shielding along the sides of the signal contacts 124 and between the signal contacts 124, such as above and/or below corresponding signal contacts 124. The struts 306 interconnect the left side rails 302 to hold the relative positions of the left side rails 302. The gaps 304 are defined between the left side rails 302 and generally follow the paths of the left side rails 302.

In an exemplary embodiment, each connecting strip 324 includes a commoning feature 326 for electrically connecting to the first ground shield 180 (shown in FIG. 4). In the illustrated embodiment, the commoning features 326 are commoning slots in the connecting strips 324 and commoning tabs; however, other types of commoning features may be used in alternative embodiments, such as channels, spring beams, clips, and the like. The commoning features 326 may be deflectable to engage and securely couple the second ground shield 182 to the first ground shield 180 when mated thereto.

The left side rails 302 are configured to extend along and follow the paths of the signal contacts 124, such as between the mating end 128 and the mounting end 130 (both shown in FIG. 1) of the electrical connector assembly 102. For example, the left side rails 302 may transition from the mating end 314 to the mounting end 320 and have different segments or portions 328 that are angled relative to each other as the left side rails 302 transition between the ends 314, 320.

With reference to FIGS. 5 and 6, when the first and second ground shields 180, 182 are assembled with the dielectric holder 142, the first and second ground shields 180, 182 coupled together. The first and second ground shields 180, 182 are mated together during assembly to mechanically and electrically connect the first and second ground shields 180, 182. The first and second ground shields 180, 182 are also mechanically and/or electrically connected along the main bodies 200, 300 by the commoning features 226, 326. For example, the commoning tabs of the commoning feature 226 are received in the commoning slot of the commoning feature 326.

When assembled, the ground shields 180, 182 form C-shaped hoods covering three sides of each pair of signal contacts 124. For example, the hoods cover both the right and left sides as well as the tops of the signal contacts 124 to shield the pair of signal contacts 124 from other pairs of signal contacts 124. When assembled, the mating portions 210, 310 of the first and second ground shields 180, 182 are configured to be electrically coupled to the mating ground shields 114 (shown in FIG. 1) in a mating zone. For example, the mating beams 212, 312 are configured to be received inside the C-shaped area of the mating ground shields 114 and engage the interior surfaces of the walls of the mating ground shields 114. The first and second ground shields 180, 182 thus provide circumferential shielding around the pairs of signal contacts 124. The circumferential shielding is provided around each pair of signal contacts 124 for substantially the entire length of the transition portions 170 (shown in FIG. 2) of the signal contacts.

Figure 7:
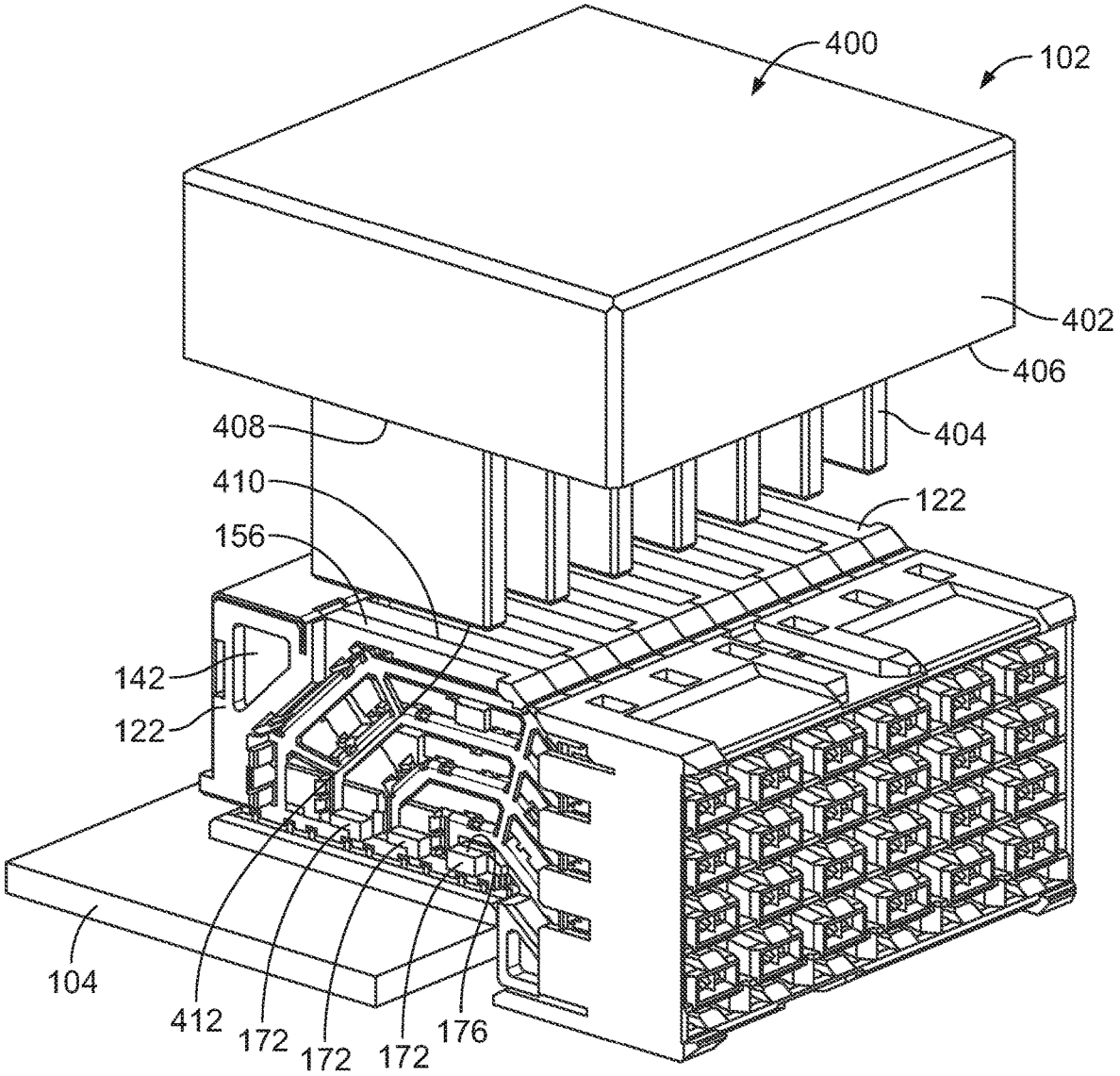
FIG. 7 is a perspective view of the electrical connector assembly showing a seating tool used for seating the electrical connector assembly on a circuit board in accordance with an exemplary embodiment.
Figure 8:
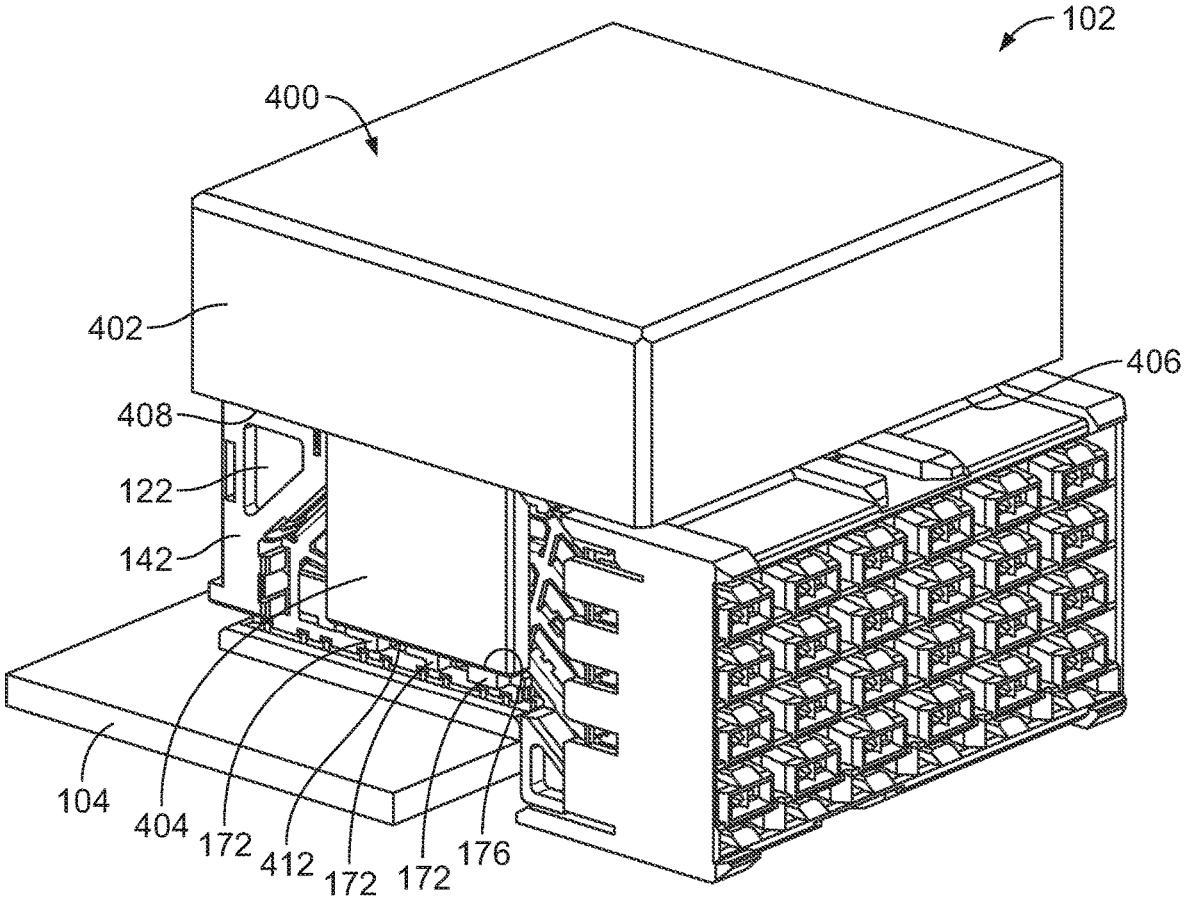
FIG. 8 is a perspective view of the electrical connector assembly showing the seating tool pressing the electrical connector assembly on the circuit board.

FIG. 7 is a perspective view of the electrical connector assembly 102 showing a seating tool 400 used for seating the electrical connector assembly 102 on the circuit board 104. FIG. 8 is a perspective view of the electrical connector assembly 102 showing the seating tool 400 pressing the electrical connector assembly 102 on the circuit board 104.

The seating tool 400 includes a base 402 and a plurality of tines 404 extending from a bottom 406 of the base 402. The base 402 has a press surface 408 at the bottom 406 configured to press against the tops 156 of the dielectric holders 142 of the contact modules 122. For example, the top 156 of each dielectric holder 142 includes an upper press surface 410. The press surfaces 176, 178 of the press tabs 172, 174 are located closer to the circuit board 104 than the upper press surfaces 410. The press surface 408 of the base 402 engages the upper press surface 410 of the dielectric holder 142 and presses against the upper press surface 410. The base 402 presses the tops 156 of the dielectric holders 142 downward during the pressing operation. The tines 404 extend below the base 402. The tines 404 have press edges 412 at distal ends of the tines 404. The press edges 412 are configured to engage the press tabs 172, 174 of the dielectric holders 142.

Figure 9:
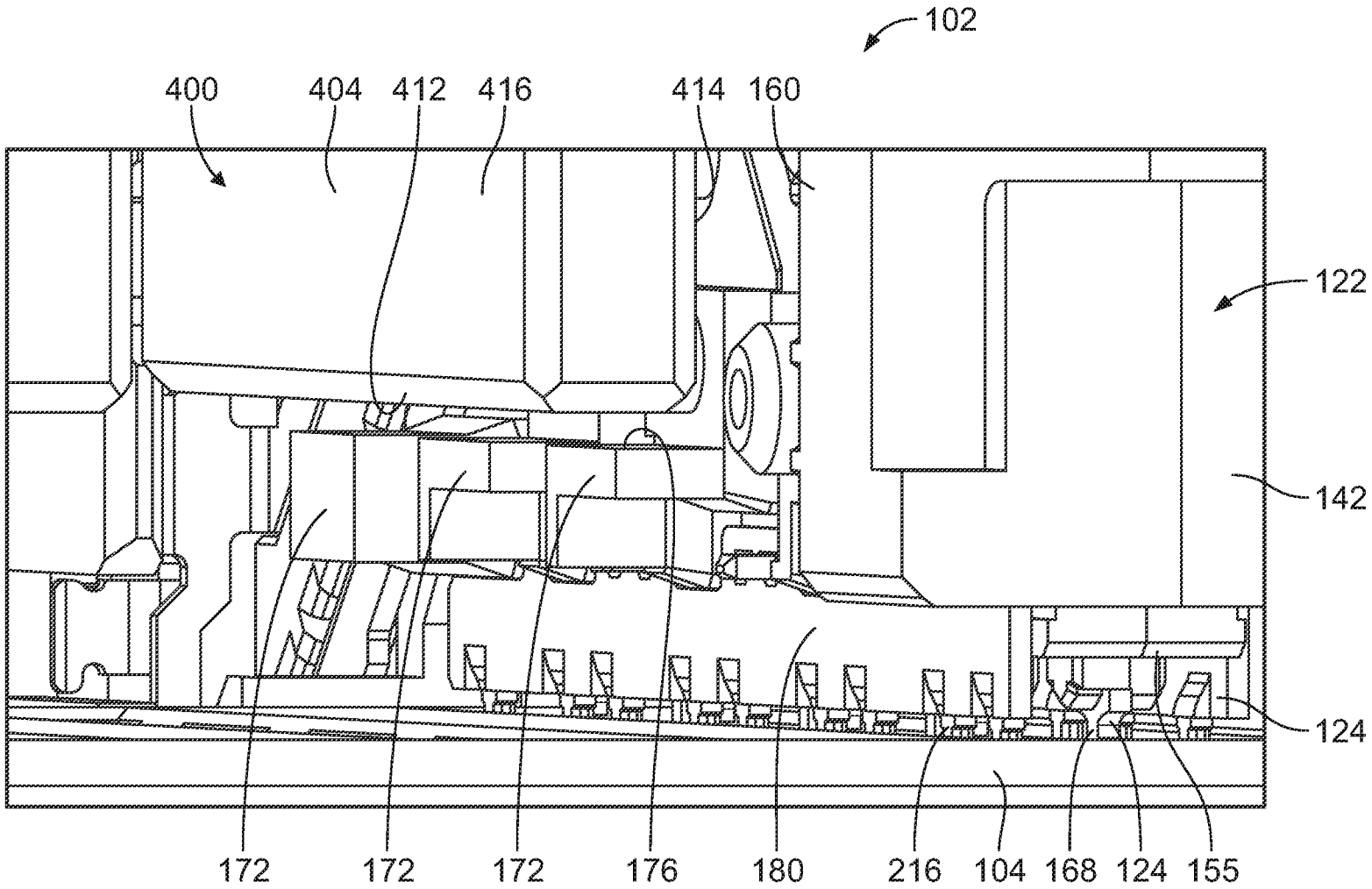
FIG. 9 is a right side perspective view of a portion of the electrical connector assembly showing the seating tool configured to engage the electrical connector assembly.
Figure 10:
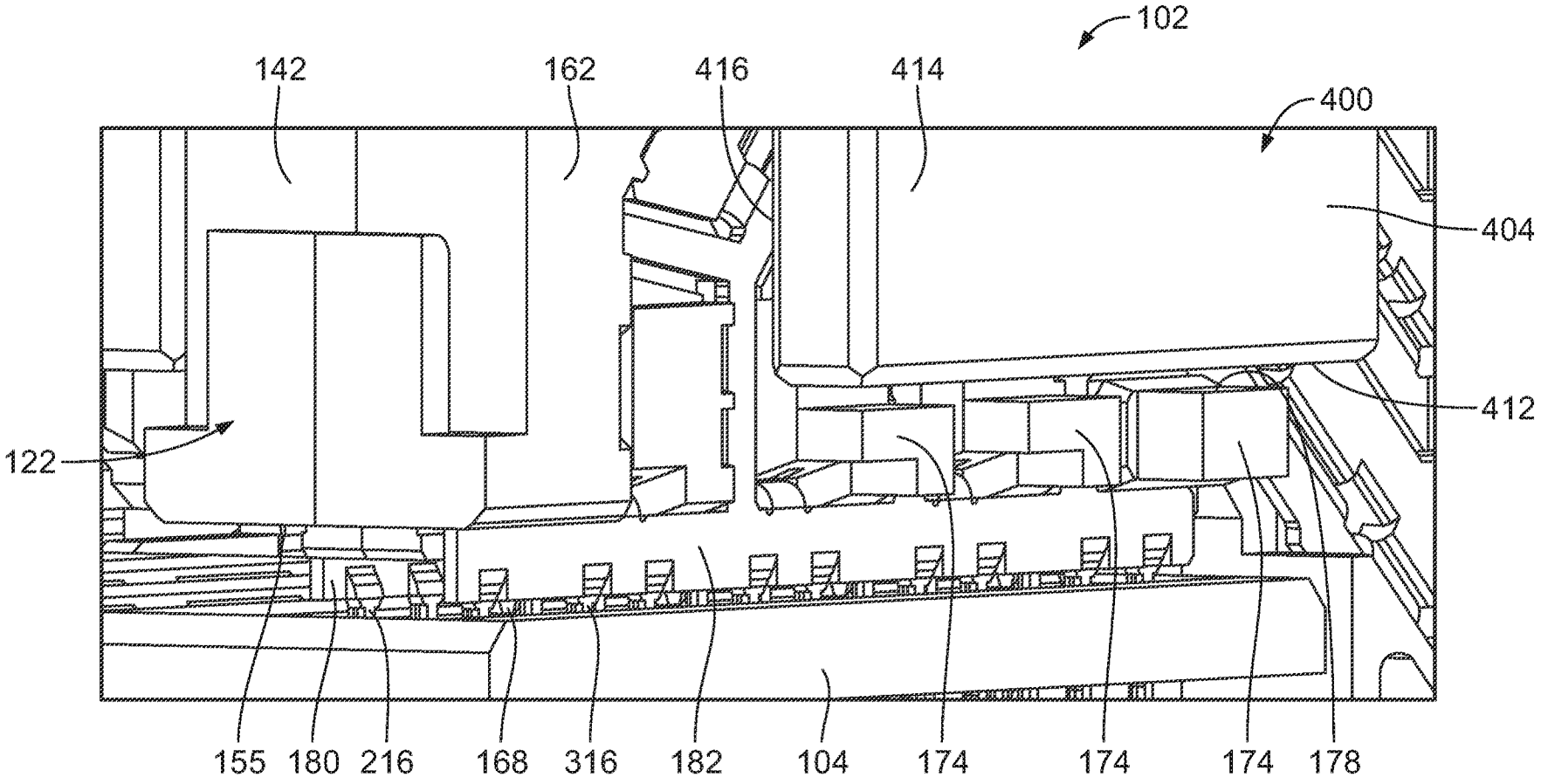
FIG. 10 is a left side perspective view of a portion of the electrical connector assembly showing the seating tool configured to engage the electrical connector assembly.
Figure 11:
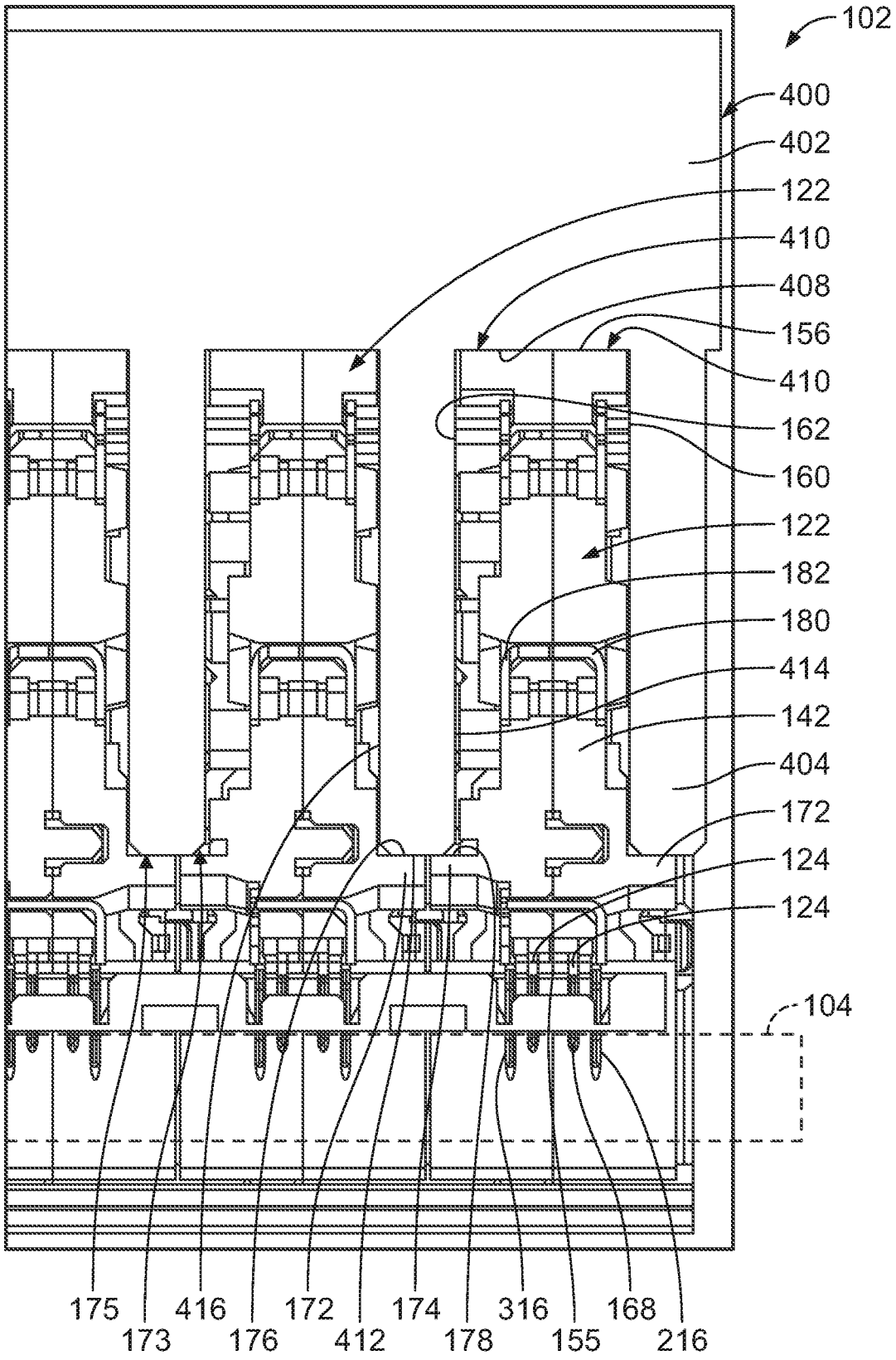
FIG. 11 is a cross-sectional view of a portion of the electrical connector assembly showing the seating tool engaging the electrical connector assembly.

FIG. 9 is a right side perspective view of a portion of the electrical connector assembly 102 showing the seating tool 400 configured to engage the electrical connector assembly 102. FIG. 10 is a left side perspective view of a portion of the electrical connector assembly 102 showing the seating tool 400 configured to engage the electrical connector assembly 102. FIG. 11 is a cross-sectional view of a portion of the electrical connector assembly 102 showing the seating tool 400 engaging the electrical connector assembly 102.

During the seating operation, the seating tool 400 is coupled to the electrical connector assembly 102 from above. The base 402 engages the tops of the contact modules 122. For example, the press surface 408 of the base 402 engages the upper press surface 410 (FIG. 11) of the dielectric holder 142 and presses against the upper press surface 410. The tines 404 are loaded between the contact modules 122. For example, as the seating tool 400 is positioned relative to the electrical connector assembly 102, the tines 404 are aligned with the pockets 173, 175 in the dielectric holders 142. The tines 404 pass through the pockets 173, 175 to engage the press surfaces 176, 178 of the press tabs 172, 174. The press edges 412 of the tines 404 engage the press surfaces 176, 178 of the press tabs 172, 174 to press the electrical connector assembly 102 on the circuit board 104. Optionally, the tines 404 are configured to engage press tabs 172, 174 of two different, adjacent contact modules 122. For example, the press tabs 172, 174 of the adjacent contact modules 122 may face each other and/or may abut against each other such that the press surfaces 176, 178 are coplanar and configured to receive the press edge 412 of the corresponding tines 404. The tines 404 engage the dielectric holders 142 at the press surfaces 176, 178 proximate to the bottoms 151 of the dielectric holders 142 to seat the mounting portions 168 of the signal contacts 124 in corresponding vias in the circuit board 104. As such, the seating tool 400 is configured to engage the dielectric holders 142 proximate to the top 156 and proximate to the bottom 155.

The seating tool 400 presses downward on the dielectric holders 142 at different locations of the dielectric holders 142 to spread the pressing forces at both the top 156 and the bottom 155. By pressing against the dielectric holders 142 proximate to the bottoms 151, the risk of buckling of the dielectric holders 142 is reduced. For example, less pressing forces are transferred from the tops 156 of the dielectric holders 142. Rather, the pressing forces are applied directly to the bottoms 151 by the tines 404 engaging the press tabs 172, 174 at the bottoms 155 of the dielectric holders 142. Thus, the seating tool 400 presses against the electrical connector assembly 102 at a location proximate to the mounting portions 168 of the signal contacts 124, and the mounting portions 216, 316 of the ground shields 180, 182. In an exemplary embodiment, the tines 404 include side surfaces 414, 416 that face the sides 160, 162 of the dielectric holders 142. Optionally, the side surfaces 414, 416 may engage the sides 160, 162 when received in the pockets 173, 175. The side surfaces 414, 416 may prevent buckling of the sides 160, 162 from the downward pressure induced at the tops 156 of the dielectric holders 142 by the base 402.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. An electrical connector assembly comprising:

a housing having a mating end, the housing having a cavity at a rear of the housing; and contact modules arranged in a contact module stack received in the cavity at the rear of the housing, each contact module including a dielectric holder having first and second sides extending between a front and a rear and extending between a top and a bottom, each contact module including signal contacts having mating portions extending forward of the front into the housing and mounting portions extending from the bottom for termination to vias in a circuit board, the dielectric holder including at least one press tab extending from at least one of the first side and the second side proximate to the bottom;

wherein the at least one press tab includes a corresponding press surface configured to be pressed downward by a seating tool to press the electrical connector assembly on the circuit board proximate to the bottom of the dielectric holder to seat the mounting portions in the vias in the circuit board.

2. The electrical connector assembly of claim 1, wherein the at least one press tab is located at the bottom of the dielectric holder.

3. The electrical connector assembly of claim 1, wherein the top includes an upper press surface, the press surface of the press tab being located closer to the circuit board than the upper press surface.

4. The electrical connector assembly of claim 1, wherein the contact module includes a pocket open at the top, the pocket being aligned with the press tab along the first side or the second side having the corresponding press tab to receive the seating tool from above the contact module.

5. The electrical connector assembly of claim 1, wherein the dielectric holder includes web portions between signal contacts, the press tab extending from a corresponding web portion, the press tab forcing the corresponding web portion downward to correspondingly force the adjacent signal contact downward to drive the corresponding mounting portion downward into the via of the circuit board.

6. The electrical connector assembly of claim 1, wherein the at least one press tab includes a first press tab extending from the first side and a second press tab extending from the second side.

7. The electrical connector assembly of claim 6, wherein the first press tab of a first of the contact modules faces the second press tab of a second of the contact modules and are configured to be engaged by a common tine of the seating tool.

8. The electrical connector assembly of claim 1, wherein each contact module includes a first ground shield provided at the first side of the dielectric holder and a second ground shield provided at the second side of the dielectric holder, the first ground shield having mating portions extending forward of the front into the housing and mounting portions extending from the bottom for termination to vias in the circuit board, the second ground shield having mating portions extending forward of the front into the housing and mounting portions extending from the bottom for termination to vias in the circuit board, the at least one press tab including a first press tab extending from the first side beyond the first ground shield proximate to the bottom and a second press tab extending from the second side beyond the second ground shield proximate to the bottom, the first and second press tabs including corresponding press surfaces.

9. The electrical connector assembly of claim 8, wherein the first ground shield includes a press bar at a bottom of the first ground shield, the mounting portions of the first ground shield extending from the press bar, the press bar being located below the first press tab, the first press tab pressing downward on the press bar of the first ground shield to press the mounting portions of the first ground shield into the vias in the circuit board, the second ground shield including a press bar at a bottom of the second ground shield, the mounting portions of the second ground shield extending from the press bar, the press bar being located below the second press tab, the second press tab pressing downward on the press bar of the second ground shield to press the mounting portions into the vias in the circuit board.

10. The electrical connector assembly of claim 1, further comprising a seating tool engaging the press surface and pressing downward on the press tab to seat the electrical connector assembly on the circuit board.

11. The electrical connector assembly of claim 10, wherein the seating tool includes a base and tines extending from the base, the tines engaging the at least one press tab.

12. The electrical connector assembly of claim 11, wherein the tines engage the first and second sides of the dielectric holders to prevent buckling of the contact modules during pressing by the seating tool.

13. The electrical connector assembly of claim 11, wherein the base engages the tops of the dielectric holders.

14. The electrical connector assembly of claim 1, wherein the first side includes a plurality of the press tabs.

15. The electrical connector assembly of claim 14, wherein the second side includes a plurality of the press tabs.

16. An electrical connector assembly comprising:

a housing having a mating end, the housing having a cavity at a rear of the housing; and contact modules arranged in a contact module stack received in the cavity at the rear of the housing, each contact module including a dielectric holder having first and second sides extending between a front and a rear and extending between a top and a bottom, each contact module including signal contacts having mating portions extending forward of the front into the housing and mounting portions extending from the bottom for termination to vias in a circuit board, each contact module including a first ground shield provided at the first side of the dielectric holder having mating portions extending forward of the front into the housing and mounting portions extending from the bottom for termination to vias in the circuit board, the dielectric holder including a first press tab extending from the first side beyond the first ground shield proximate to the bottom;

wherein the top of the dielectric holder includes an upper press surface and the first press tab includes a first press surface located closer to the circuit board than the upper press surface, the upper press surface and the first press surface being configured to be pressed downward by a seating tool to press the electrical connector assembly on the circuit board to seat the mounting portions in the corresponding vias in the circuit board.

17. The electrical connector assembly of claim 16, wherein the dielectric holder includes a second press tab extending from the second side, the second press tab having a second press surface located closer to the circuit board than the upper press surface.

18. The electrical connector assembly of claim 16, wherein the contact module includes a pocket open at the top, the pocket being aligned with the first press tab along the first side to receive the seating tool from above the contact module.

19. An electrical connector assembly comprising:

a housing having a mating end, the housing having a cavity at a rear of the housing; and contact modules arranged in a contact module stack received in the cavity at the rear of the housing, each contact module including a dielectric holder having first and second sides extending between a front and a rear and extending between a top and a bottom, each contact module including signal contacts having mating portions extending forward of the front into the housing and mounting portions extending from the bottom for termination to vias in a circuit board, each contact module including a first ground shield provided at the first side of the dielectric holder and a second ground shield provided at the second side of the dielectric holder, the first ground shield having mating portions extending forward of the front into the housing and mounting portions extending from the bottom for termination to vias in the circuit board, the second ground shield having mating portions extending forward of the front into the housing and mounting portions extending from the bottom for termination to vias in the circuit board, the dielectric holder including a first press tab extending from the first side beyond the first ground shield proximate to the bottom and a second press tab extending from the second side beyond the second ground shield proximate to the bottom;

wherein the first press tab includes a first press surface and the second press tab includes a second press surface, the first and second press surfaces configured to be pressed downward by a seating tool to press the electrical connector assembly on the circuit board proximate to the bottom of the dielectric holder to seat the mounting portions in the corresponding vias in the circuit board.

20. The electrical connector assembly of claim 19, wherein the top includes an upper press surface, the press surface of the press tab being located closer to the circuit board than the upper press surface.

* * * * *